US006471330B1

(12) United States Patent
Umeda et al.

(10) Patent No.: US 6,471,330 B1
(45) Date of Patent: Oct. 29, 2002

(54) MAINTENANCE CAP FORMING A SEALED CONDITION AROUND NOZZLE ROWS OF AN INK JET PRINT HEAD

(75) Inventors: Takaichiro Umeda, Nagoya (JP); Hiroshi Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/663,096

(22) Filed: Sep. 15, 2000

(30) Foreign Application Priority Data

Sep. 16, 1999 (JP) ..... 11-261526
Sep. 16, 1999 (JP) ..... 11-261527

(51) Int. Cl.[7] ..... B41J 2/165
(52) U.S. Cl. ..... 347/29
(58) Field of Search ..... 347/29, 24, 30, 347/43

(56) References Cited

U.S. PATENT DOCUMENTS 4,967,203 A * 10/1990 Doan et al. ..... 347/43 X
5,027,134 A * 6/1991 Harmon et al. ..... 347/29
5,504,508 A * 4/1996 Hashimoto ..... 347/24
5,602,573 A * 2/1997 Waschhauser et al. ..... 347/33
5,940,097 A 8/1999 Imai
6,007,180 A 12/1999 Muraki

FOREIGN PATENT DOCUMENTS

JP A 2000-62201 2/2000

* cited by examiner

*Primary Examiner*—Lamson Nguyen
(74) *Attorney, Agent, or Firm*—Oliff & Berridge, PLC

(57) ABSTRACT

A cap member is for covering, during suction operations, nozzle rows formed in a single nozzle plate of an ink jet head on an ink jet printer. The cap member includes a surrounding lip, a partitioning lip, and a body. The surrounding lip is for forming a sealed condition around the nozzle rows when in intimate contact with the nozzle plate during suction operations. The partitioning lip is for forming, with the outer lip portion, partitioned spaces that separate the nozzle rows from each other. The body is formed from resin and includes an integral base portion and protruding portion. The base portion is formed with a separate suction hole for each partitioned space. The protruding portion protrudes away from the base portion. At least one of the surrounding lip and the partitioning lip cover the protruding portion.

11 Claims, 5 Drawing Sheets

MAINTENANCE CAP FORMING A SEALED CONDITION AROUND NOZZLE ROWS OF AN INK JET PRINT HEAD

BACKGROUND OF THE INVENTION

1. Field of the Invention

The present invention relates to an ink jet printer with a maintenance cap for protecting ink ejection nozzles formed in a nozzle surface of a print head, and for providing a sealed condition around the nozzles so purging to maintain good ejection conditions can be performed.

2. Description of the Related Art

One known ink jet printer includes an ink jet head having a single nozzle plate formed with rows of nozzles. FIG. 1 shows a conventional maintenance cap 100 used to contact the nozzle plate to form a sealed space around the nozzles so purging can be effectively performed. The maintenance cap 100 includes a body 103 and a lip portion 105 integrally formed from rubber. An opening 101 is formed in the body and surrounded by the lip portion 105.

Before a purge operation, the lip portion 105 is brought into intimate sealing contact with the nozzle plate of the ink jet head, so that the nozzle rows in the nozzle plate are surrounded by the lip portion 105 and exposed in the opening 101. Then a suction pump (not shown) connected to the maintenance cap 100 is operated to produce a negative pressure in the opening 101. Ink is drawn by the negative pressure from the nozzles into the opening, and to a waste ink tank (not shown). Dried ink, air bubbles, dust, and the like are flushed out of the nozzles with the flow of ink, so that good ejection condition can be maintained.

SUMMARY OF THE INVENTION

It is sometimes desirable to perform purge operations separately for different nozzle rows, for example, when each nozzle row is specifically for ejecting a particular color ink. However, when the conventional maintenance cap 100 is used for purge operations, all nozzle rows surrounded by the lip portion 105 are purged at the same time. Accordingly, with the conventional maintenance cap 100, even nozzle rows that do not need purging are purged together with the desired nozzles, so ink is wasted.

Also, the conventional cap member 100 can easily deform because it is formed entirely from rubber. Therefore, the lip portion 105 can collapse under the negative pressure developed in the opening 101 during a suction operation, and cover the nozzles of the ink jet head. Also, rubber is slightly permeable to air, so the opening 101 in the cap 100 can be in an insufficiently airtight condition during suction operations.

It is a first objective of the present invention to provide a maintenance cap that enables purging nozzle rows separately.

It is a second objective of the present invention to achieve the first objective without increasing the size of the maintenance cap.

It is a third objective of the present invention to provide a cap member with a lip portion that will not collapse under negative pressure during suction operations and that has reliable airtight properties.

In order to achieve the first objective, a cap member according to a first aspect of the present invention for covering, during suction operations, nozzle rows formed in a single nozzle plate of an ink jet head of an ink jet printer, includes a surrounding lip, a partitioning lip, and a body. The surrounding lip is for forming a sealed condition around the nozzle rows when in intimate contact with the nozzle plate during suction operations. The partitioning lip is for forming, with the outer lip portion, partitioned spaces that separate the nozzle rows from each other. The body s connected to the surrounding lip and the partitioning lip, and is formed with a separate suction hole for each partitioned space.

With this configuration, because the partitioning lip separates nozzle rows from each other, and because a suction hole is provided for each space partitioned by the partitioning lip, when a suction operation for preventing nozzle clogs is performed on an ink jet head with a nozzle plate formed with a plurality of nozzle rows, then each nozzle row in each partitioned space can be separately suctioned. Therefore, only a minimal amount of ink required to effectively purge desired nozzles is used, because nozzle rows that do not need to be purged are not purged.

It is desirable that the surrounding lip and the partitioning lip according to the first aspect of the present invention be elongated in a lengthwise direction in parallel with each other, to form elongated and parallel aligned partitioned spaces for separating nozzle rows that are parallel aligned and separated from each other in a widthwise direction perpendicular to the lengthwise direction. With this configuration, when the cap member covers the nozzle plate, each nozzle row is sealed in a separate partition space provided with an individual suction hole. Therefore, suction operations can be performed separately for each nozzle row, so that only desired rows of all the nozzle rows are purged.

In order to achieve the second objective, it is desirable that the body according to the first aspect of the present invention be formed with the suction holes for each partitioned space positioned shifted from each other by a distance in the lengthwise direction. With this configuration, suction tubes connected to the suction holes can overlap in the direction perpendicular to the direction in which the nozzle rows extend. Therefore, the cap member can be produced in a small size.

It is desirable that the surrounding lip according to the first aspect of the present invention be elongated in a lengthwise direction and the partitioning lip is be elongated in a widthwise direction perpendicular to the lengthwise direction, to form elongated and linearly aligned partitioned spaces for separating linearly aligned nozzle rows. With this configuration, even if the plurality of nozzles are linearly aligned, each nozzle row is sealed within an independent partitioned space during suction operations. Because a suction hole is provided for each partitioned space, these suction holes can be used to perform suction operations only on desired nozzle rows, so that ink is not wasted.

It is desirable that the body according to the first aspect of the present invention be formed from resin and include an integral base portion and protruding portion. In this case, the suction holes are formed in the base portion, the protruding portion protrudes away from the base portion, and at least one of the surrounding lip and the partitioning lip covers the protruding portion.

In order to achieve the third objective, a cap member according to a second aspect of the present invention includes a resin body, and a resilient rubber lip member. The resin body includes an integral base portion and protruding portion. The protruding portion protrudes away from the base portion. The resilient rubber lip member is adapted for intimate sealing contact with the ink jet head, and covers at least the protruding portion of the resin body.

With this configuration, the base portion and the protruding portion are formed integrally together from resin as the body. Therefore, when a suction operation is performed to prevent nozzles from clogging, the rubber lip portion will not collapse. Also, the portion of the lip portion that needs to be formed from rubber is minimized. Because synthetic resin has high airtight properties, a reliable sealed condition can be maintained during suction operations.

It is desirable that the protruding portion according to the second aspect of the present invention be elongated in at least a lengthwise direction of the base portion, so that the lip member can be reliably supported by the protruding portion. Therefore, the lip portion can be effectively prevented from collapsing during suction operations.

It is desirable that the lip member according to the second aspect of the present invention include a surrounding lip and a partitioning lip. The surrounding lip is for forming a sealed condition around a plurality of nozzle rows formed in the nozzle plate of the ink jet head. The partitioning lip is for forming, with the surrounding lip, partitioned spaces that sealingly separate the nozzle rows from each other. In this case, it is further desirable that the body according to the second aspect of the present invention be connected to the surrounding lip and the partitioning lip, and be formed with a separate suction hole for each partitioned space.

It is desirable that the lip member according to the second aspect of the present invention be mounted on the protruding portion, and protrude away from the protruding portion to a distance less than a protruding distance of the protruding portion. Because the lip member is mounted thinly on the surface following the shape of the protruding portion, the lip portion can be effectively prevented from collapsing during purge operations.

It is desirable that the lip member according to the second aspect of the present invention be formed with a thickness of 1.0 mm or less. With this configuration, the lip member can be effectively prevented from collapsing without the lip member protruding greatly upward away from the protruding portion. Also, because air can pass through rubber, increasing the thickness of the rubber lip member greater than 1.0 mm will reduce airtight properties of the cap member. Therefore, it is desirable to form the lip member with a thickness of 1.0 mm or less.

When the lip member is formed with a rectangular shape as viewed in plan, and the lengthwise edge is 10 mm or greater, the problem of the lip portion collapsing under negative pressure of suction operations increases dramatically. However, because the rubber lip portion is supported by the protruding portion, the problem of the lip portion collapsing under negative pressure of suction operations can be overcome.

It is desirable that the lip member according to the second aspect of the present invention be formed from a rubber material with hardness of 40° or greater. Hardness is defined in accordance with JIS K 6301. With this configuration, the lip portion can be effectively prevented from collapsing under negative pressure during suction operations.

BRIEF DESCRIPTION OF THE DRAWINGS

The above and other objects, features and advantages of the invention will become more apparent from reading the following description of the embodiment taken in connection with the accompanying drawings in which.

DETAILED DESCRIPTION OF THE EMBODIMENTS

Figure 1:
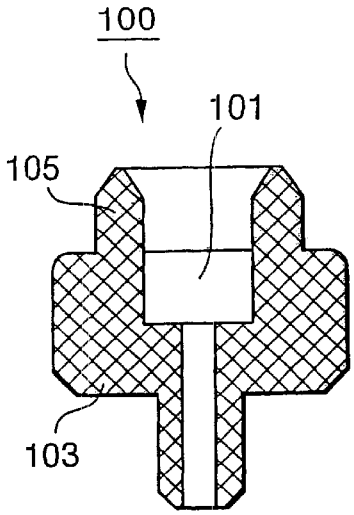
FIG. 1 is a cross-sectional view showing a conventional maintenance cap.
Figure 2A:
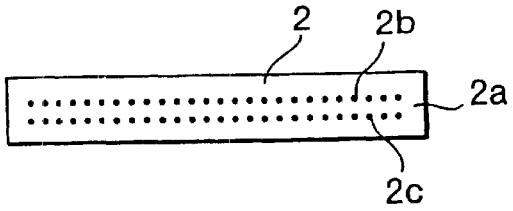
FIG. 2(A) is a plan view showing an ink jet head.

A maintenance cap 1 according to a first embodiment of the present invention will be described with reference to FIGS. 2(A) to 8. The maintenance cap 1 of the present embodiment is adapted for use with an ink jet head 2 shown in FIG. 2(A). As shown in FIG. 2(A), the ink jet head 2 includes a nozzle surface 2*a* formed with two rows 2*b*, 2*c* of nozzles aligned in parallel with each other and separated by a distance. The maintenance cap 1 and the ink jet head 2 are used in an ink jet printer, such as that described in U.S. Pat. Nos. 5,940,097 and 6,007,180, the disclosures of which are hereby incorporated by reference.

As shown in FIGS. 2(B) to 5, the maintenance cap 1 includes a resin body 21, a surrounding lip 3, and a partitioning lip 5.

The surrounding lip 3 and the partitioning lip 5 are formed from an integral rubber member, desirably made from a material with low vapor permeability in order to maintain a good seal during suction operations. Examples for the material of the integral rubber member include acrylonitrile butadiene rubber (NBR) and butyl rubber (IIR). The rubber material of the integral rubber member desirably has a hardness of between 30 to 60°, and preferably 40° or greater. Hardness is defined in accordance with JIS K 6301. The integral rubber member is desirably formed to a thickness of 0.1 to 2.0 mm, and preferably to a thickness of 1.0 mm or less.

Figure 2B:
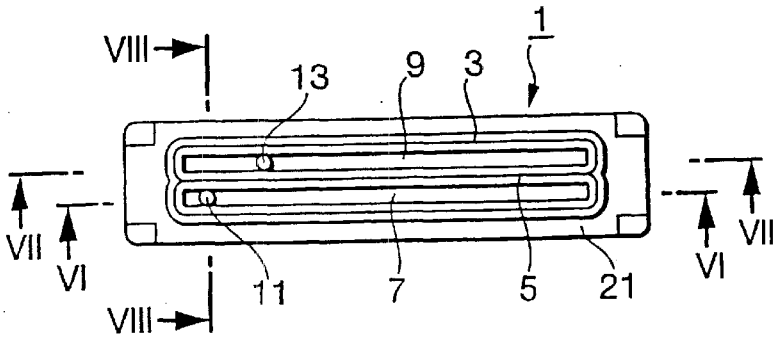
FIG. 2(B) is a plan view showing a maintenance cap according a first embodiment of the present invention.
Figure 3:
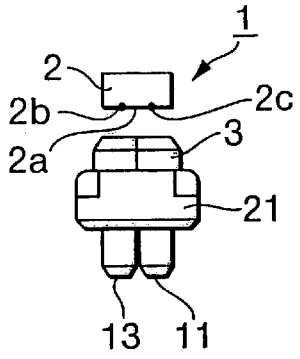
FIG. 3 is an end view showing the maintenance cap of FIG. 2(B) disposed in confrontation with the ink jet head of FIG. 2(A)

As shown in plan view in FIG. 2(B), the surrounding lip 3 has a rectangular shape, with the partitioning lip 5 and the surrounding lip 3 elongated to extend parallel with each other in a lengthwise direction of the cap member 1, to a length of 10 mm or greater. The partitioning lip 5 and the surrounding lip 3 define therebetween two partitioned spaces 7, 9, which are also elongated in the lengthwise direction.

Figure 6:
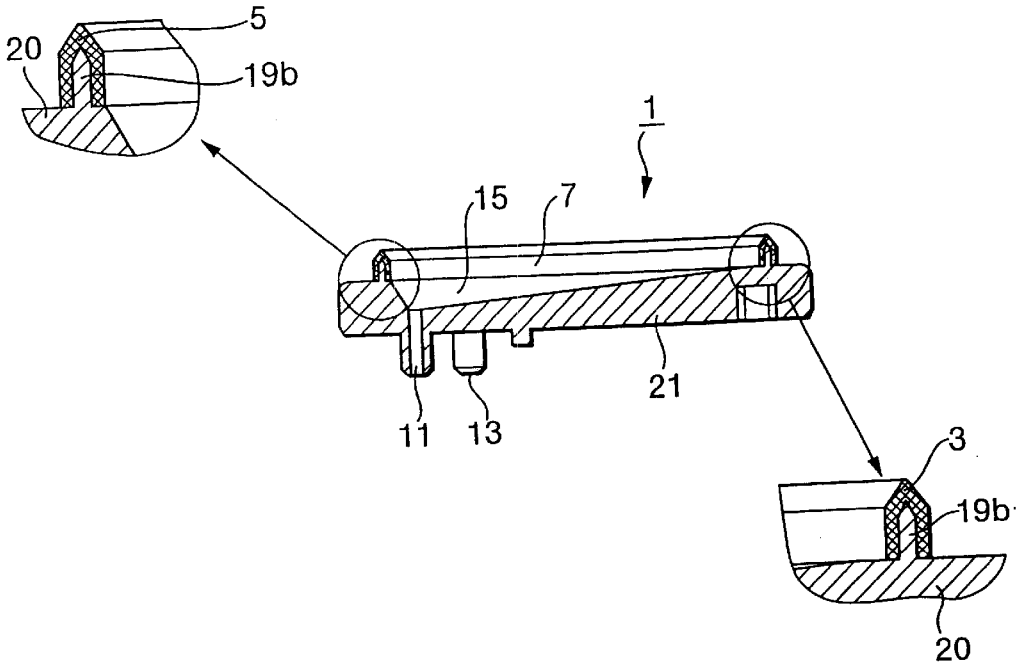
FIG. 6 is a cross-sectional view taken along line VI—VI of FIG. 2(B)
Figure 7:
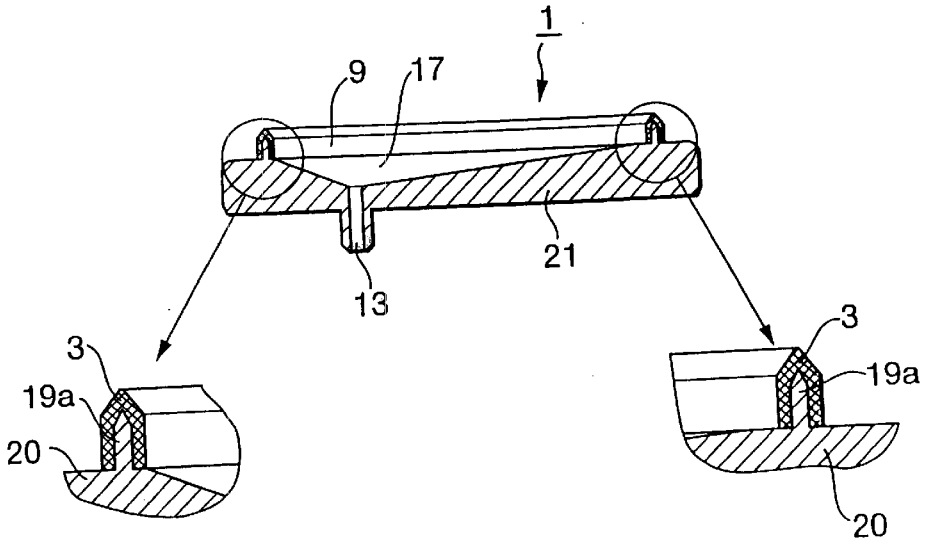
FIG. 7 is a cross-sectional view taken along line VII—VII of FIG. 2(B)
Figure 8:
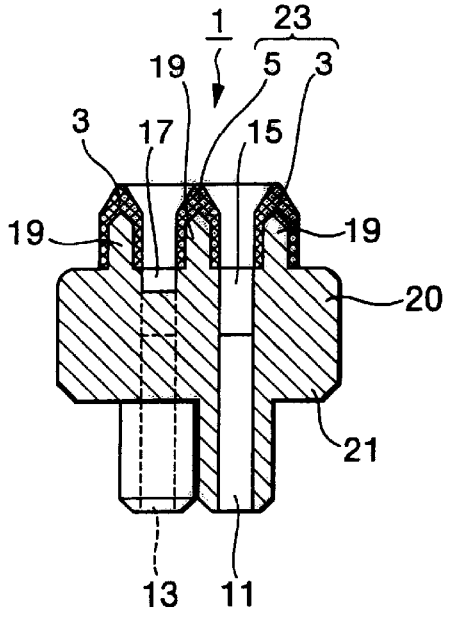
FIG. 8 is a cross-sectional view taken along line VIII—VIII of FIG. 2(B)

As shown in FIGS. 6 to 8, the resin body 21 includes a base portion 20 and ribs 19*a*, 19*b*. The base portion 20 and the ribs 19*a*, 19*b* are formed integrally together from the same resin material. It is desirable to form the body 21 from a heat resistant resin material, such as polybutylene terephthalate (PBT resin) or polyphenylene sulfide (PPS resin).

The base portion 20 is formed with openings 15, 17 and suction holes 11, 13. The openings 15, 17 are connected with the suction holes 11, 13, respectively, and with the partitioned spaces 7, 9, respectively, so that consequently the suction holes 11, 13 are in fluid communication with the partitioned spaces 7, 9, respectively. The suction holes 11, 13, are shifted out of alignment from each other by a distance in the lengthwise direction in which the surrounding lips 3 and the partitioning lip 5 are elongated.

The ribs 19*a*, 19*b* extend upward from the base portion 20 to a predetermined height. The ribs 19*a* extend from the upper edge of the openings 15, 17 into the lengthwise sides of the surrounding lip 3. The rib 19*b* extends from between the openings 15, 17 into the partitioning lip 5. Said differently, the lips 3, 5, cover the ribs 19*a*, 19*b*.

Figure 4:
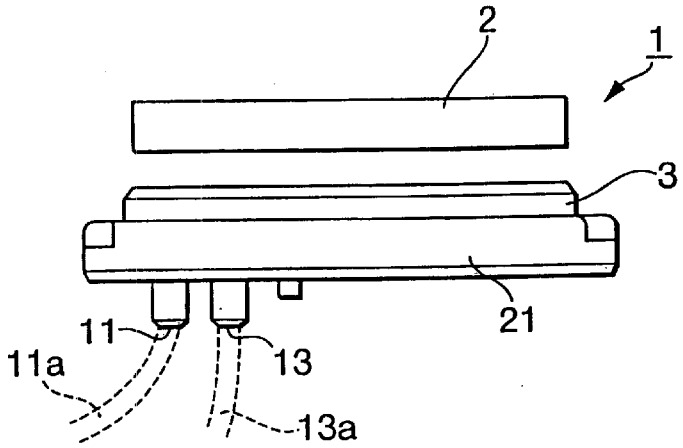
FIG. 4 is a side view showing the maintenance cap of FIG. 2(B) disposed in confrontation with the ink jet head of FIG. 2(A)
Figure 5:
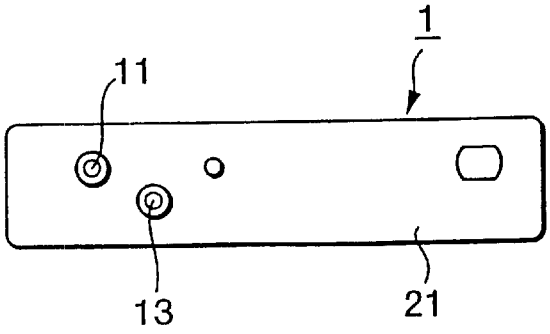
FIG. 5 is a rear view of the maintenance cap of FIG. 2(B)

As shown in FIG. 4, suction tubes 11*a*, 13*a* are connected to the suction holes 11, 13. The suction tubes 11*a*, 13*a* are connected to a suction pump (not shown) of the ink jet printer.

During a purge operation for preventing nozzle clogs, the maintenance cap 1 is brought into intimate contact with the nozzle surface of the ink jet head 2, so that the partitioning lip 5 is disposed between and aligned parallel with the nozzle rows 2*b*, 2*c*. At this time, the partitioned spaces 7, 9 and the openings 15, 17 form sealed chambers around each nozzle row 2*b*, 2*c*. Then, the suction pump is driven to produce a negative pressure in a desired one or both of the partitioned spaces 7, 9. The negative pressure draws ink, along with bubbles, dried ink, and the like, from the nozzle of the corresponding nozzle row 2*b*, 2*c*, in order to maintain the ink jet head 2 in a good ejection condition.

Because the surrounding lip 3 and the partitioning lip 5 separate the two nozzle rows 2*b*, 2*c* from the other, and because the suction holes 11, 13 are in fluid communication with separate ones of the partitioned spaces 7, 9, then each nozzle row 2*b*, 2*c* disposed in each of the partitioned spaces 7, 9 can be separately suctioned through the suction holes 11, 13 when a suction operation for preventing nozzle clogs is performed on the ink jet head 2. Only the minimal amount of ink required to effectively purge desired nozzles is used, because a nozzle row 2*b*, 2*c* that does not need to be purged is not purged. That is, suction operations can be performed on each nozzle row separately, so that ink is not wasted.

Also, because the suction holes 11, 13 in different partitioned spaces 2, 9 are shifted from each other in the lengthwise direction in which the partitioning lip 5 extends, the suction tubes 11*a*, 13*a* connected to the suction holes 11, 13 can overlap in the widthwise direction, which is perpendicular to the lengthwise direction. Therefore, the maintenance cap can be produced in a small size. That is, if the suction holes where formed adjacent to each other in the direction in which the partitioning lip extends, then the suction tubes attached to the holes would bump into each other, so the partition spaces, and consequently the nozzle rows in the ink jet head, would need to be formed farther apart.

Because the ribs 19*a*, 19*b*, which form the core of the lips 3, 5, are formed integrally with the body 21 from the same resin material, the ribs 19*a*, 19*b* support the lips 3, 5, so that the lips 3, 5 will not collapse inward from negative pressure generated in the openings 15, 17 and the partitioned spaces 7, 9 during a suction operation. Also, only a minimal amount of the maintenance cap 1 needs to be made from rubber. Because plastic is extremely airtight, the ribs 19*a*, 19*b* contribute to forming a reliable sealed condition during suction operations and in preventing the ink in the nozzles of the nozzle surface 2*a* from drying out.

Because the integral member of the lips 3, 5 is mounted thinly on the surface following the shape of the protruding ribs 19*a*, 19*b*, the lips 3, 5 can be effectively prevented from collapsing during purge operations. That is, the lips 3, 5 protrude away from the protruding ribs 19*a*, 19*b*, to a distance less than the protruding distance of the protruding ribs 19*a*, 19*b*. Therefore, the amount of rubber, which is relatively flexible, is minimal compared to the amount of resin, which is relatively rigid. More particularly, because the rubber member of the lips 3, 5 is formed with a thickness of 1.0 mm or less, the lips 3, 5 can be effectively prevented from collapsing without the lips 3, 5 protruding greatly upward away from the protruding ribs 19*a*, 19*b*. Also, because air can pass through rubber, increasing the thickness of the rubber member greater than 1.0 mm will reduce airtight properties of the maintenance cap 1. Therefore, it is desirable to form the rubber member of the lips 3, 5 with a thickness of 1.0 mm or less.

Because the lips 3, 5 have a rectangular shape with the lengthwise edge of 10 mm or greater, there is a great potential for the lips 3, 5 to collapse under negative pressure of suction operations. However, because the lip 3, 5 are supported by the protruding ribs 19*a*, 19*b*, the lips 3, 5 can be prevented from collapsing under negative pressure during suction operations.

Because the lips 3, 5 are formed from a rubber material with hardness of 40° or greater, the lips 3, 5 can be effectively prevented from collapsing under negative pressure during suction operations.

Figure 9A:
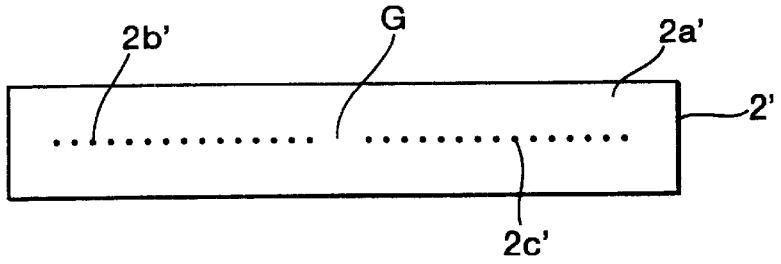
FIG. 9(A) is a plan view showing another ink jet head.

Next, a maintenance cap 10 according to a second embodiment of the present invention will be described with reference to FIGS. 9(A), 9(B), and 10. The maintenance cap 10 according to the second embodiment is used with an ink jet head 2' shown in FIG. 9(A). The ink jet head 2' has a nozzle plate 2*a'* formed with two nozzle rows 2*b'* and 2*c'*. The nozzle rows 2*b'*, 2*c'* are linearly aligned separated by a gap G in the direction in which the nozzle rows 2*b'*, 2*c'* are aligned.

Figure 9B:
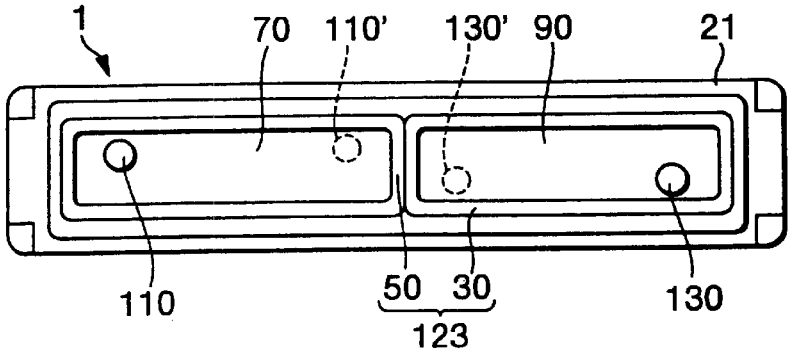
FIG. 9(B) is a plan view showing a maintenance cap according to a second embodiment of the present invention.
Figure 10:
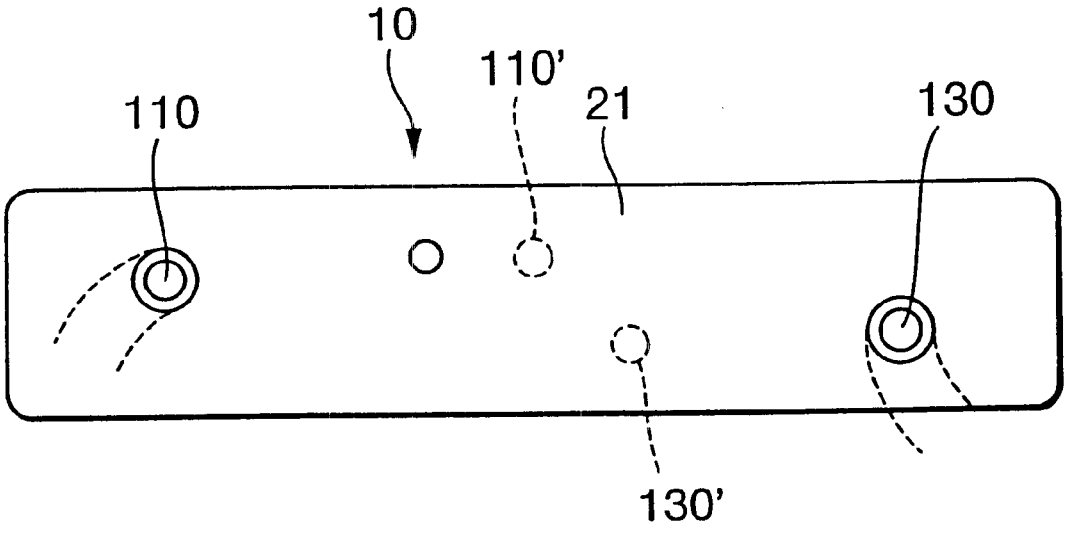
FIG. 10 is a rear view showing the maintenance cap of FIG. 9(B).

As shown in FIGS. 9(B) and 10, the maintenance cap 10 includes a body 121 and a lip member 123. The lip member 123 includes a surrounding lip 30 and a partitioning lip 50 that define partitioned spaces 70, 90. The partitioning lip 50 is located so that when the maintenance cap 10 covers the print head, the partitioning lip 50 is centered between the two nozzle rows, and so partitions the two nozzle rows from each other.

The body 121 is formed from resin with two suction holes 110, 130. The suction hole 110 is in fluid communication with the partitioned space 70 and the suction hole 130 is in fluid communication with the partitioned space 90. With this configuration, the nozzles rows can be purged one at a time. Although not shown in the drawings, the body 21 is formed with ribs that are similar to the ribs 19 of the body 121 according to the first embodiment. Because the ribs are made from the same airtight resin of the body 121, the ribs contribute to forming a reliable sealed condition during suction operations and in preventing the ink in the nozzles of the nozzle surface from drying out.

While the invention has been described in detail with reference to specific embodiments thereof, it would be apparent to those skilled in the art that various changes and modifications may be made therein without departing from the spirit of the invention, the scope of which is defined by the attached claims.

For example, although the suction holes 11, 13 are shifted from each other with respect to the elongation direction of the partitioning lip, the suction holes can be positioned at the same position with respect to the elongation direction of the partitioning lip, without being shifted.

The embodiments describe the protruding resin ribs being provided for each rubber lip. However, a rib need only be provided for desired ones of the lips.

Also, suction holes 110' and 130 can be formed in locations indicated in dotted line to FIGS. 9 and 10, instead of the suction holes 110, 130. Because the suction holes 110' and 130 are shifted from each other in the direction of elongation of the partitioning lip 50, they achieve the effect that suctions tubes connected to the suction holes 110', 130' do not bump into each other, and the size of the maintenance cap can be maintained small.

What is claimed is:

1. A cap member for use with an ink jet printer, for covering, during suction operations, nozzle rows formed in a single nozzle plate of an ink jet head of the ink jet printer, the cap member comprising:

a surrounding lip for forming a sealed condition around the nozzle rows when in intimate contact with the nozzle plate during suction operations;

a partitioning lip for forming, with the outer lip portion, partitioned spaces that separate the nozzle rows from each other; and a body connected to the surrounding lip and the partitioning lip, and formed with a separate suction hole for each partitioned space, wherein the surrounding lip and the partitioning lip are elongated in a lengthwise direction in parallel with each other, to form elongated and parallel aligned partitioned spaces for separating nozzle rows that are parallel aligned and separated from each other in a widthwise direction perpendicular to the lengthwise direction and the suction holes formed in the body for each partitioned space are positioned shifted from each other by a distance in the lengthwise direction.

2. A cap member as claimed in claim 1, wherein the body is formed from resin and includes an integral base portion and protruding portion, the suction holes being formed in the base portion, the protruding portion protruding away from the base portion, at least one of the surrounding lip and the partitioning lip covering the protruding portion.

3. A cap member for use with an ink jet printer, for providing an intimate seal around at least one nozzle row formed in a nozzle plate of an ink jet head of the ink jet printer, the cap member comprising:

a resin body including an integral base portion and protruding portion, the protruding portion protruding away from the base portion in a protrusion direction; and a resilient rubber lip member adapted for intimate sealing contact with the ink jet head, and that covers only the protruding portion of the resin body, wherein the lip member includes a surrounding lip and a partitioning lip elongated in a lengthwise direction in parallel with each other, to form elongated and parallel aligned partitioned spaces for separating nozzle rows that are parallel aligned and separated from each other in a widthwise direction perpendicular to the lengthwise direction and suction holes are formed in the body for each partitioned space and are positioned shifted from each other by a distance in the lengthwise direction.

4. A cap member as claimed in claim 3, wherein the protruding portion is elongated in at least a lengthwise direction of the base portion.

5. A cap member as claimed in claim 3, wherein the surrounding lip forms a sealed condition around a plurality of nozzle rows formed in the nozzle plate of the ink jet head, the partitioning lip forms, with the surrounding lip, partitioned spaces that sealingly separate the nozzle rows from each other and the body is connected to the surrounding lip and the partitioning lip.

6. A cap member as claimed in claim 3, wherein the lip member is mounted on the protruding portion, and protrudes away from the protruding portion to a distance less than a protruding distance of the protruding portion.

7. A cap member as claimed in claim 3, wherein the lip member is formed to a thickness in the protrusion direction from a tip end of the protruding portion to a tip end of the lip member of 1.0 mm or less.

8. A cap member as claimed in claim 3, wherein the lip member is formed in a rectangular shape as viewed in plan, the rectangular shape having lengthwise sides at least 10 mm long.

9. A cap member as claimed in claim 3, wherein the lip member is formed from a rubber material with hardness of 40° or more.

10. A cap member for use with an ink jet printer, for providing an intimate seal around at least one nozzle row formed in a nozzle plate of an ink jet head of the ink jet printer, the cap member comprising:

a resin body including an integral base portion and protruding portion, the protruding portion protruding away from the base portion in a protrusion direction; and a resilient rubber lip member adapted for intimate sealing contact with the ink jet head, and that covers at least the protruding portion of the resin body, wherein the lip member is formed to a thickness in the protrusion direction from a tip end of the protruding portion to a tip end of the lip member of 1.0 mm or less.

11. A cap member as claimed in claim 10, wherein the lip member is formed from a rubber material with hardness of 40° or more.

* * * * *